United States Patent [19]

Rosen et al.

[11] 4,058,258

[45] Nov. 15, 1977

[54] INTERIOR PIPE COATING APPARATUS

[76] Inventors: Paul W. Rosen, 218 Grove, Oak Park, Ill. 60302; Cary A. Gunderson, 7103 Northcote, Hammond, Ind. 46324

[21] Appl. No.: 492,446

[22] Filed: July 29, 1974

[51] Int. Cl.[2] ..... B05B 3/18

[52] U.S. Cl. ..... 239/165; 118/306; 239/187; 239/224; 239/229

[58] Field of Search ..... 239/184, 186, 187, 225, 239/229, 224, 244, 165, 164; 118/306, 317, 318, 323, 72, 105

[56] References Cited

U.S. PATENT DOCUMENTS

| | | | |
|---|---|---|---|
| 2,133,329 | 10/1938 | Moore et al. | 239/186 |
| 2,970,771 | 2/1961 | Przystawik | 239/244 X |
| 3,106,491 | 10/1963 | Leibner | 118/72 X |
| 3,109,262 | 11/1963 | Weaver et al. | 239/186 X |
| 3,111,431 | 11/1963 | Weaver | 118/105 |
| 3,276,695 | 10/1966 | Giardino et al. | 239/142 |
| 3,351,289 | 11/1967 | Demaison | 239/187 X |
| 3,401,988 | 9/1968 | Pingree | 118/306 X |
| 3,439,912 | 4/1969 | Berger | 239/187 X |
| 3,459,586 | 8/1969 | Kiwiet et al. | 239/224 X |
| 3,827,633 | 8/1974 | Kouno et al. | 118/306 X |

*Primary Examiner*—Evon C. Blunk
*Assistant Examiner*—Michael Mar
*Attorney, Agent, or Firm*—Gary, Juettner & Pyle

[57] ABSTRACT

A coating apparatus for coating the interior surface of a relatively long, narrow pipe without any portion of the apparatus contacting the interior of the pipe has been provided, and comprises a mobile vehicle carrying a traveling boom on which is mounted a coating or spraying device for coating the pipe, an adjustment mechanism for moving the boom relative to the vehicle and to align the boom with the pipe, and a driving and supporting mechanism for the boom which drives and also supports the boom as it moves into and out of the relatively long, narrow pipe. In addition, several alternative embodiments of spraying devices for the coating apparatus are disclosed which eliminate or reduce "ghosting" or "shading" problems frequently experienced in coating such pipe.

9 Claims, 12 Drawing Figures

INTERIOR PIPE COATING APPARATUS

BRIEF SUMMARY OF THE INVENTION

This invention relates to pipe coating apparatus and more particularly to coating apparatus for the interior of a pipe or the like.

Modern coating materials, such as epoxies, are now available for coating the interior surfaces of pipe, particularly concrete pipe, and make such pipe useful for purpose heretofore not contemplated and/or extend the life of the pipe. These modern coating materials are expensive, and in order to make their use feasible, the minimum thickness coating necessary to do the job must be uniformly applied throughout the length of the pipe. While irregularities or misses could be covered up with an extra coat, such procedure is expensive both in manpower and in materials.

Further, such pipe is usually long and narrow, making coating and/or inspection difficult. Such pipe may have a length of from a few feet to 24 or more feet and a width of from a few inches to 4 or more feet, the ratio of the length to width being 3:1 or greater so that it is difficult to coat such pipe uniformly manually.

Heretofore, various prior art devices have been utilized to coat the interior surface of pipe, such as shown in U.S. Pat. No. 2,800,875, which shows a pipe coating assembly fixedly mounted on stanchions and includes a movable beam reciprocable into and out of a pipe, the pipes being brought individually to the device. Such device may be suitable for "in plant" production line coating but cannot be used on the job site, in the field or at a pipe storage yard where the pipes are already stacked. The extra labor, expense and lost time required to unstack the pipes, bring them to such device, and coat and restack them make it prohibitively expensive to use such device.

More importantly, in such prior art device the boom must be supported by roller structure in engagement with the inner surface of the pipe. Such contact with the inner surface of the pipe is detrimental since it increases the possibility of contamination of that surface by dirt from the support and/or interfers with the previously prepared interior surface of the pipe, such prior preparation being extremely important to the effectiveness of today's coating systems. Further, the use of interior supports in the pipe doubles the time required to coat the pipe since coating material may be applied only on the return travel or stroke of the boom, any coating material applied during the forward travel being disrupted or destroyed by passage of the support over the just coated surface. Other similar prior art pipe coating devices having the foregoing disadvantages are shown in the following patents: U.S. Pat. Nos. 3,516,385; 2,470,796; 2,792,807; 2,334,294; 2,551,722; 2,048,912. All these patents require some form of support, be it a brush or swab for application of the coating material or separate supports engaging the inner surface of the pipe.

Another type prior art device, which was useful only in the larger diameter pipes, was a mobile vehicle which carried the coating applicator through the pipe. Typical devices of this type are shown in U.S. Pat. Nos. 2,897,779 and 3,155,319, and, of course, had the above-mentioned disadvantage of contacting the pipe surface.

As previously mentioned, one form of applicator for the coating material was a brush or swab, as shown in U.S. Pat. No. 2,551,722. While this type of applicator did provide support, it did not result in a uniform coating since it left "brush marks" and/or "misses." A better way to apply the coating material is by a spray technique, such as with the rotary spray head shown in U.S. Pat. No. 3,719,168. While satisfactory, that spray head is not adjustable for the various viscosities of coating materials or changes in ambient or operation conditions, such inflexibility being disadvantageous in that it is difficult to apply the minimum thickness coating desired.

When using rotary spray heads it is essential that the head be stably supported at the center of the pipe since such heads have a tendency to apply more coating material to one side of an irregularity or object on the pipe surface than to the other side, as is discussed in U.S. Pat. No. 3,455,728. This condition is referred to as "ghosting" or "shading" and is worsened by undue movement of the spray head from the center of the pipe due to inadequate support. The tendency to "ghost" or "shade" is probably the reason heretofore prior rotary spray heads were either limited to use in coating the interiors of relatively short and wide objects, such as the standard 55 gallon drum, or were used in conjunction with support structure engaging the inner surface of the pipe, as was discussed above. Heretofore, no rotary spray head is believed to have been used to coat the interior of relatively long, narrow pipe without supports contacting the interior of the pipe.

The coating or spraying apparatus of the present invention for coating the interior of a pipe has overcome the foregoing disadvantages and makes possible the uniform coating or spraying of relatively long, narrow pipes while still stacked in a plant, yard or storage area, thus reducing labor and expense, on both the forward and return strokes of the apparatus, thus reducing coating time, and without need for internal supports, thus reducing possible contamination. The coating or spraying apparatus of the present invention comprises a mobile vehicle carrying a reciprocable or traveling boom which in turn carries coating or spraying means for coating the pipe, adjustment means for positioning the boom in various positions relative to the vehicle and in alignment with the pipe, and means on the vehicle for both driving and supporting the traveling boom as it moves through the pipe.

Unlike prior devices, the driving and supporting means is of relatively low profile or height to permit entry of the boom into and the coating of long, narrow pipes without the need for supports contracting or bearing on the internal surface of the pipe. The stable supporting means for the traveling boom and spraying means also greatly assists in eliminating or minimizing "ghosting."

In addition, "ghosting" is further reduced by the use of one of the alternative spraying means for the apparatus of the present invention which varies one of the velocity vectors of the sprayed material to provide a more uniform coating on opposite sides of an irregularity in the pipe.

If the length of the pipe is too great, even for the novel apparatus of the present invention, an auxiliary air car support may be fitted to the traveling boom so as to support the boom and spraying means still without disruptive contact of the pipe surface.

In addition, the coating apparatus of the present invention may be arranged to also coat vertical pipes, such as already installed street manholes.

These and other advantages of the coating or spraying apparatus of the present invention will become apparent from the following written description and the accompanying figures of the drawings.

DESCRIPTION OF THE PREFERRED EMBODIMENTS

Figures 1, 2, 3, 4:
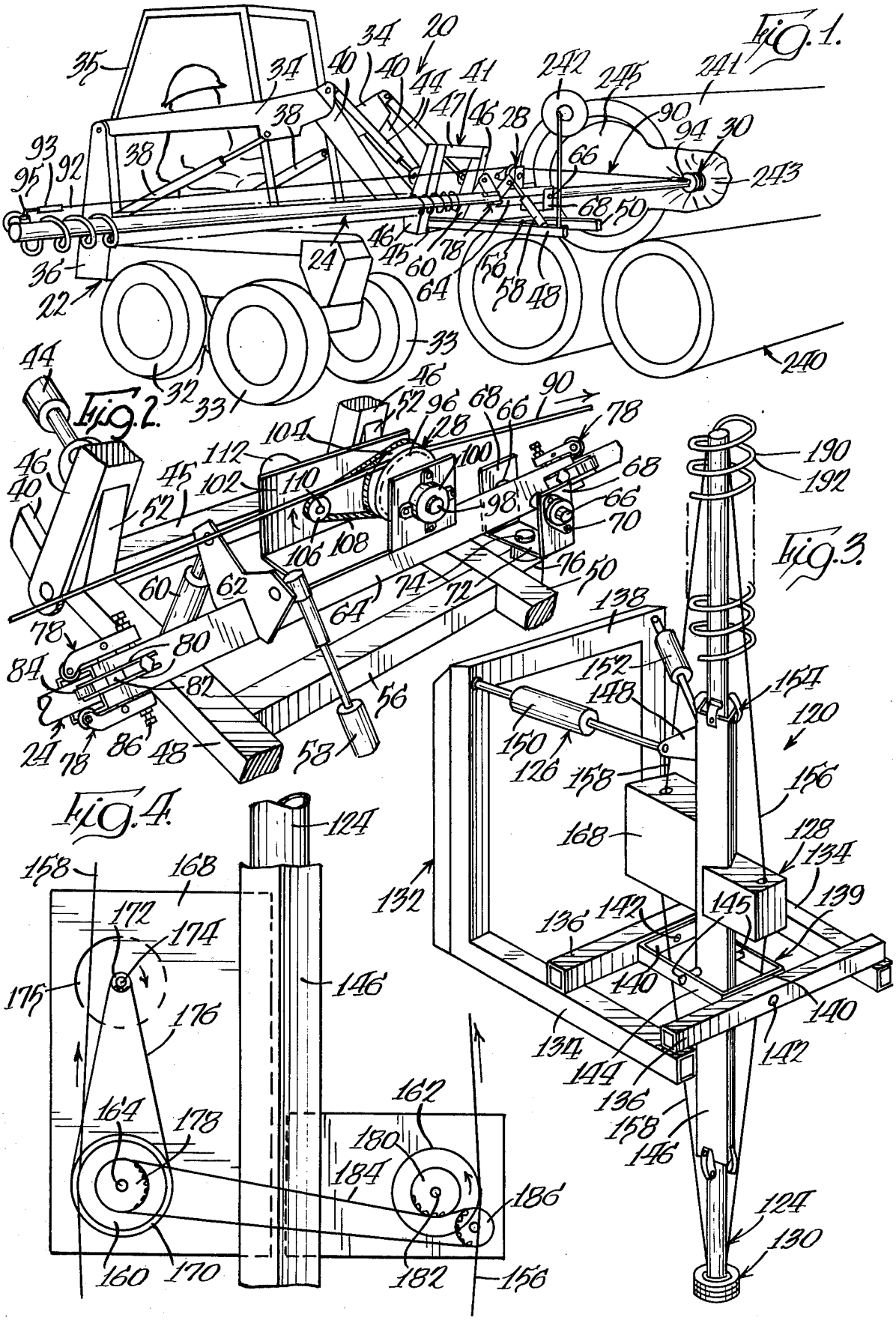
FIG. 1 is a perspective view of one embodiment of coating or spraying apparatus of the present invention for coating horizontally stacked pipes.
FIG. 2 is an enlarged perspective view of a portion of the apparatus of FIG. 1.
FIG. 3 is a perspective view of a second embodiment of spraying apparatus of the present invention for coating vertical pipes, such as street manholes.
FIG. 4 is an enlarged cross-sectional view of a portion of the apparatus of FIG. 3.

Referring to FIG. 1, a first embodiment of pipe coating apparatus 20 of the present invention for coating surface of pipe or the like, particularly the inner surfaces of pipes already horizontally stacked, comprises a mobile vehicle or tractor 22, a traveling boom 24 carried by the tractor and movable relative to the pipe, adjustment means 26 for changing the relative position of the traveling boom with respect to the tractor and aligning the boom with the pipe, means 28 for driving or moving and suspending or supporting the boom as it moves through the pipe without contacting the inner surface of the pipe, and coating or spraying means 30 for coating or spraying the pipe surface.

The tractor 22 is a commercial type, such as normally used with an overhead fork lift, that has been modified, by removal of portions of the fork lift, to more particularly suit the requirements of the present invention. The tractor 22 has a motor driving two rear wheels 32 and two forward wheels 33, an auxiliary hydraulic system (not shown), a mechanical power-take-off (not shown), and a cab 35 for an operator mounted above the tractor frame 36.

The traveling boom 24 is carried on the tractor 22 by adjustment means 26 which will now be described, the traveling boom 24 being more fully described later.

Adjustment means 26 comprises portions of the tractor fork lift mechanism and other portions carried thereon in place of the fork lift prongs, which have been removed. As is conventional, the fork lift mechanism has a pair of large arms 34 pivotally mounted at the rear of the tractor frame 36 and may be raised or lowered by hydraulic cylinders 38 mounted between the frame 36 and arms 34. A pair of somewhat smaller arms 40 are in turn pivotally connected to the forward ends of the larger arms 34. The forward ends of the smaller arms 40 are pivotally connected to a generally vertical, rectangular, transverse support frame 41 having a lower member 45, a pair of side members 46 and an upper member 47. A hydraulic cylinder 44 is connected between each of the large arms 34 and mediate portions of each of the side members 46 for movement of the arms 40 and structure 45–47. The cylinders 38 and 44 are connected in a conventional manner through control valves to the hydraulic system of the tractor so that the relative position of these arms and members can be varied.

Referring to FIG. 2, the support frame 41 includes a pair of longitudinally extending frame members 48 and 50 having rear vertical extensions 52 secured to the side members 46, as by welding. Intermediate portions of the frame members 48 and 50 are secured together by a cross-member 56. The frame members 48 and 50 carry other portions of adjustment means 26 for the traveling boom 24, as will now be described. At the end of the cross member 56 adjacent the frame member 48 is a pair of leveling cylinders 58 and 60, each having their lower ends pivotally secured to the frame member 48 and their upper ends pivotally secured to opposite ends of a plate member 62. The leveling cylinders 58 and 60 are arranged in a generally vertical, longitudinal plane, but are inclined toward each other, and are connected to the hydraulic system of the tractor by conventional control valves. The lower center edge of the plate 62 is secured to one end of a cradle 64 comprising a length of hollow, square tubing having a length of about 2 feet, an outside dimension of 2 inches and an inside dimension of $1\frac{3}{4}$ inches. The cradle 64 is mounted to the plate 62 so that it extends generally horizontally and transversely to the tractor. The other end of the cradle 64 is pivotally mounted to the frame member 50 by a pair of stub shafts 66 passing through openings in a pair of spaced vertical plate portions 68 and received in bearing assemblies 70 secured to the plates 68. The lower ends of the portions 68 are secured to a horizontal plate portion 72 which in turn is pivotally mounted to a vertical shaft 74 extending from a bracket 76 on the frame 50 so that the cradle 64 may be pivoted both horizontally and vertically. Thus, the position of the cradle 64 relative to the frame members 48 and 50 and the tractor 22 may be precisely altered vertically and/or horizontally by adjusting the leveling cylinders 58 and 60, this adjustment being in addition to that provided by the arms 34 and 40 and cylinders 38 and 44 on the tractor. The adjustment means 26 permits the height and relative forward position and the longitudinal and transverse level or pitch of the traveling boom 24 to be altered so that it may be precisely aligned with the pipe being coated.

The traveling boom 24 is carried by the tubular cradle 64 and is of sufficient length to extend fully through the pipe being coated. In the present instance, the traveling boom 24 has a length of about 20 feet, an inside diameter of $1\frac{1}{4}$ inches and an outside diameter of $1\frac{1}{2}$ inches. The boom 24 extends through the center opening of the tubular cradle 64 and is supported by four bearing assemblies 78 at each end of the cradle 64. Each bearing assembly 78 comprises a pair of arms 80 pivotally mounted at their centers to a boss 82 extending from and welded to one of the flat, outer surfaces of the square, tubular cradle 64. A roller 84 is rotatably mounted to the outer ends of the arms 80 and can engage the traveling boom 24, and the other ends of the arms 80 carry an adjustment screw 86 which bears against the tubular cradle 64 and can be turned to vary the clearance or contact the roller makes with the boom 24 so that the boom 24 can be removed or a larger diameter boom can be installed, if desired. As can be appreciated, the traveling boom 24 is free to slide in the bearing assemblies 78 relative to the cradle 64 and, of course, into a pipe to be coated a distance of about 17 feet.

Means 28 for driving, braking, and supporting or stabilizing the boom as it moves, comprises a flexible cable 90 having its opposite ends 92 and 94 secured to the boom 24 and a driven cable pulley 96 around which a mediate portion of the cable 90 is wrapped. The flexible cable 90 is of ⅛ inch diameter stainless steel, of a length of about 22 feet, and has ends fitted with turnbuckles 93 and hooks 95 for engaging openings in the traveling boom 24. The cable pulley 96 is about 4 inches in diameter so that when the cable 90 is wrapped one full turn thereon, it takes up about 1 foot of the cable's length. The pulley 96 is mounted on a shaft 98 which in turn is rotatably mounted in bearings 100 secured to a generally U-shaped bracket 102. The bracket 102 is secured to a portion of the tractor, such as by being welded to an upper, center portion of the cradle 64. The center of the cable pulley 96 is mounted about 6 inches above the longitudinal axis of the boom 24 so that the cable 90 is close to the boom and will not interfere with or touch the inner surface of even a relatively small diameter pipe. The included angle between the cable 90 and the boom 24 varies as the boom travels, from about 20° at the short end of the boom, to 4° at the long end of the boom. The relatively low angle of the cable 90 still provides good support and stability for the boom to prevent its sagging since the boom 24 and spraying means 30 are of light weight. Of course, the use of the support cable 90 makes it possible to use a relatively light weight tube for the boom, such as aluminum. Further, the eccentric or off-center attachment of the cable 90 to to the boom eliminates the need for separate means to prevent the round boom 24 from rotating or turning in the cradle 64.

A relatively large diameter driven sprocket 104 is also secured to or mounted on the shaft 98 so as to rotate with the pulley 96, and is driven by a smaller diameter drive sprocket 106 through a chain 108 or the like. The drive sprocket 106 in turn is mounted on an output shaft 110 of a gear type, reversible air motor 112 which extends through an opening in the bracket 102. The air motor 112 is also secured to the bracket 102, is controlled by valves in the cab 35, and supplied by an air compressor (not shown) which may be driven by the power-take-off shaft of the tractor motor. The gear reduction ratio of the air motor 112 is relatively high so that to some degree it helps brake of slow the movement of the boom 24. Thus, when the air motor 112 is rotated clockwise, as shown in FIG. 2, it drives the small sprocket 106, the large sprocket 104 and the cable pulley 96 clockwise and drives the cable 90 and traveling boom 24 to the right, or into the pipe as shown in FIG. 1. If the air motor 112 is rotated in the opposite direction, the boom 24 is moved to the left or withdrawn from the pipe.

Spraying means 30 for coating the pipe is carried on the end of the traveling boom 24 and will be described in greater detail later.

Referring to FIG. 3, a second embodiment of pipe coating apparatus 120 of the present invention for coating surfaces of pipe, particularly the inner surface of vertical pipe or manholes already in the ground, is generally similar to the apparatus 20 previously described, the main difference being that the apparatus 120 extends itself downwardly vertically rather than to one side horizontally. Of course, it would be relatively easy for a man skilled in the art to adapt the apparatus 120 to operate horizontally as does apparatus 20. Apparatus 120 comprises a generally vertical traveling boom 124 adapted to be carried by a tractor, such as one similar to the tractor 22, adjustment means 126 for changing the relative position of boom 124 and aligning it with the pipe to be coated, means 128 for driving or moving the boom and suspending or supporting the boom, and spraying means 130 for coating the pipe. The support frame 132 of the apparatus 120 is somewhat different from the support frame 41 of the apparatus 20, in that it has a pair of L-shaped members 134 which are joined by a pair of lower cross members 136 and an upper cross member 138. Any one of several of the cross members or frame members could be secured to a portion of the tractor, such as the arms 40 of the tractor 22. The lower cross members 136 carry a gimbal frame 139 having front and rear sides 140 which are pivotally mounted between the lower cross members 136 by a pair of stub shafts 142. The other or lateral sides 144 of the gimbal frame 139 carry short stub shafts 145 which pivotally mount a square, vertical, tubular cradle 146 carrying the traveling boom 124. The other or upper end of the tubular cradle 146 has a plate 148 on which a pair of tipping cylinders 150 and 152 are pivotally mounted. The tipping cylinders 150 and 152 are in a horizontal plane, extend toward each other, and are pivotally mounted at their other ends to the upper cross member 138. Movement of the tipping cylinders 150 and 152 can pivot or tip the cradle 146 and traveling boom 124 longitudinally or transversely on the gimbal frame 139.

The traveling boom 124 is similar to that of apparatus 20 but is shorter in length, being about 10 feet, and is round in cross-section. The traveling boom 124 is guided by four bearings assemblies 154 at each end of the cradle, which are similar to the bearing assemblies 78 of apparatus 20.

Driving and support means 128 is similar to means 28 of the apparatus 20, except that two flexible cables 156 and 158 are used, instead of one. The use of two cables helps to prevent any off-center forces being exerted on the traveling boom and helps support the vertical weight of the boom which is all carried by the cables. As shown in FIG. 4 each of the cables 156 and 158 is wrapped at least one full turn around its own cable pully 160 and 162, respectively. The left most cable pulley 160 is mounted on a shaft 164 journaled in bearings (not shown) secured to the bracket or housing 168. The shaft 164 carries a large diameter sprocket 170 driven through a belt or chain 176, by a small sprocket 172 mounted on a shaft 174 of an air motor 175. In order to have the other cable 156 leave the pulley 162 at the maximum distance from the boom 124 to provide better support, that pulley 162 must rotate in the opposite direction of pulley 160. The opposite direction rotation is achieved by having another or first sprocket 178 mounted or secured on the shaft 164 which in turn drives a similar size second sprocket 180 mounted or secured to the shaft 182 of the pulley 162, the shaft 182 being mounted in bearings secured to the housing 168. A chain 184 or the like connects the sprockets 178 and 180, wrapping around the first sprocket 178 but only partially wrapping around the second sprocket 180, and also wrapping around an idler sprocket 186 mounted on the housing 168. Thus, as the air motor shaft 174 rotates clockwise, as shown in FIG. 4, the cables 156 and 158 and traveling boom 124 move upward; rotating the shaft 174 in the opposite direction, of course, moves the boom 124 downward.

The spraying means 130 is used in conjunction with spraying equipment including a coating or paint pump (not shown) and coating or paint containers (not shown) carried on the rear of the tractor. The paint or coating material is delivered by the pump through a hose (not shown) to a first coiled hose 190 encircling the traveling boom 124, the coiling facilitating and accommodating the relative movement of the traveling boom. The hose 190 enters the center opening of the boom and extends therethrough to the other end to connect to the spraying means 130. In addition to a paint line 190, a compressed air line 192 for powering the spraying means 130 also is similarly coiled or arranged and extends through the center of the traveling boom.

Figure 5:
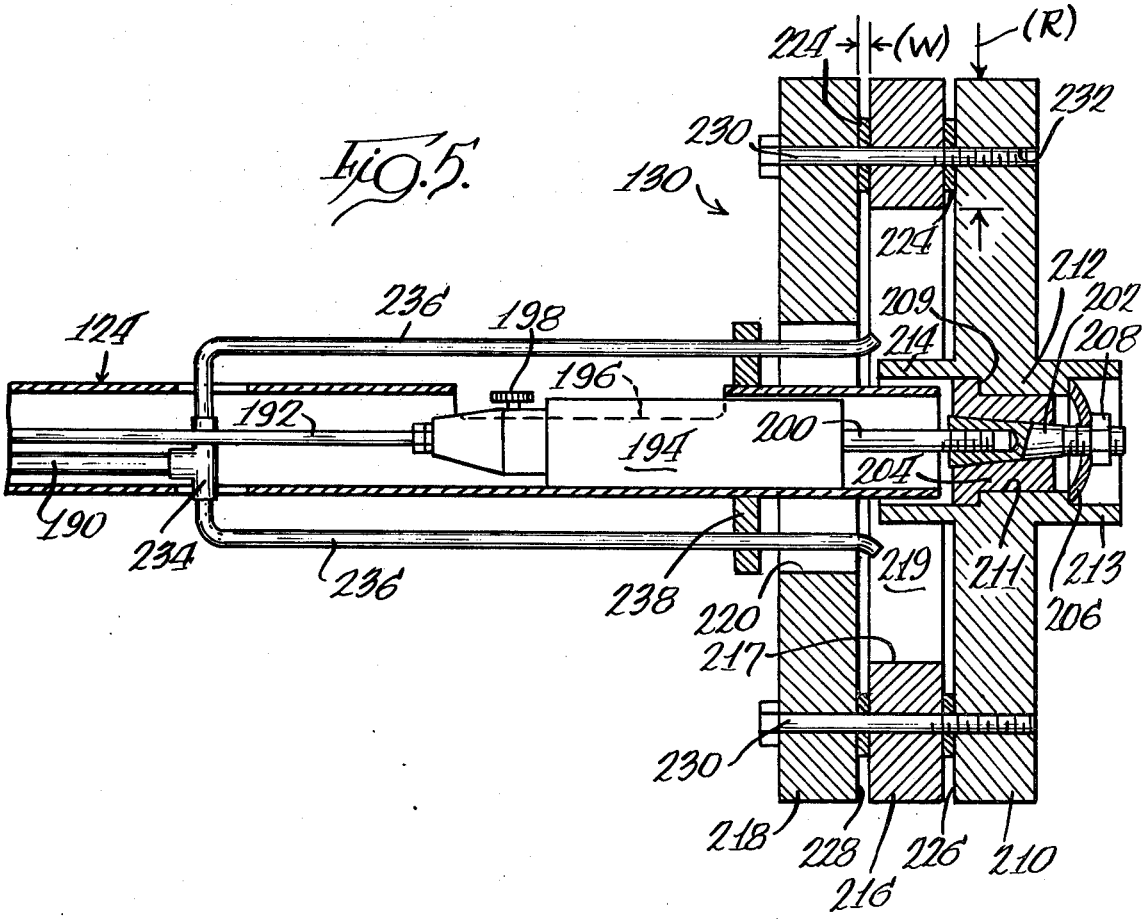
FIG. 5 is a cross-sectional view of the spraying means of the embodiments shown in FIGS. 1 and 3.

Referring now to FIG. 5, details of the spraying means 130 will now be described in conjunction with apparatus 120, it being understood that spraying means 30 of apparatus 20 is similar. Spraying means 130 comprises a plurality of disc members that are held spaced apart by spacers to form generally annular paint exiting slots and means for spinning the discs, the latter, preferably being an air motor 194. The air line 192 extends through the center of the traveling boom 124 and is connected to the air inlet of the air motor 194, which preferably is rotatable in either direction. As shown an opening or cut-out 196 is provided in the boom 124 to provide access to a motor control valve 198, the motor 194 being held in the boom 124, as by shims so that it is in press-fit engagement with the tubular boom. The motor 194 has a threaded, rotating output shaft 200 which extends out the end of the boom 124 and receives a tapered arbor or shaft 202. The tapered shaft 202 in turn receives a shouldered bushing 204 at one end and a spring type washer 206 and a nut 208 at the other end.

Spray means 130 includes a first or front disc 210, a second or intermediate disc 216, and a third or rear disc 218, all being made of light weight material, like nylon and having an outside diameter of about 5 inches. This size permits coating of pipes of only a few inches larger diameter, say 7 inches, and if smaller size pipes are to be coated a smaller unit may be used. The first disc 210 has an opening 211 with an internal shoulder 212 abutted at one end by an external shoulder 209 on the bushing 204 and abutted at the other end by the washer 206 to hold the disc 210 to the shafts 200 and 202 and to be thus, rotated by the air motor 194. The first disc 210 includes an outer annularly extending section 213 which extends over the nut 208 and outer threads of the shaft 202 to prevent build up of spray deposits thereon and an inner annularly extending section 214 which cooperates with the end of the tubular boom 124 to form a labyrinth type seal to prevent entry of paint or coating material into the center of the boom and the air motor.

Figure 6:
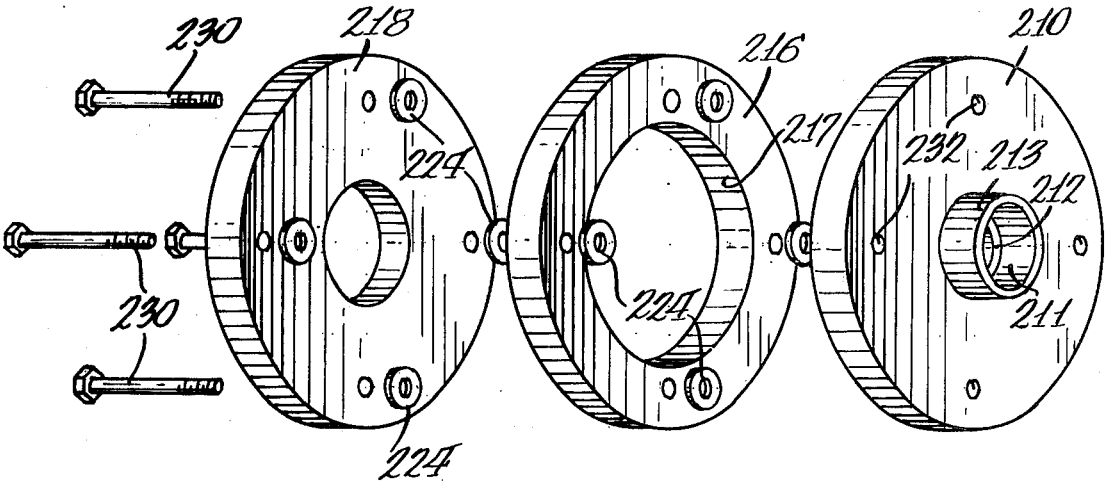
FIG. 6 is an exploded perspective view of portions of FIG. 5.

The first disc 210 cooperates with the second disc 216 and the third disc 218 to form an internal paint or coating material receiving chamber 219. As shown in FIG. 6, except for the inner and outer annular portions 213 and 214, the first disc 210 is flat on both sides. Also the disc 216 is flat on both sides but has a large opening 217 at its center to form the chamber 219, and the disc 218 is also flat on both sides having a smaller opening 220 at its center for the boom. The flat shape of the discs 210, 216 and 218 simplify cleaning and prevent build up of coating material in corners or grooves. The discs 210, 216 and 218 are held spaced from the adjacent disc or discs by a plurality of spacers or washers 224 so that generally annular slots or peripheral orifices 226 and 228 are formed between the discs 210 and 216 and discs 216 and 218, respectively. The discs 210, 216 and 218 and the spacers 224 therebetween are held in assembled relation by a plurality of fasteners or bolts 230 which pass through openings in the discs 218 and 216 and spacers 224 and engage threaded openings 232 provided in disc 210, and the discs may be easily disassembled for cleaning.

Coating material is supplied to the interior chamber 219 of the spray means 130 by the hose 190 which has a tee 234 at its end to divide the flow into two symmetrical streams to prevent uneven loading or unbalancing of the rotating spray disc assembly. From the tee 234 two separate lines 236 extend along the outside of the boom and are carried by a support or hanger 238 secured to the boom and extend into the opening 220 to the interior of the disc 216. From there the material is driven outwardly by centrifical force through the annular slots or orifices 226 and 228 onto the wall of the pipe. The quantity of paint or coating material delivered to the spray head 130 is adjusted so that it is less than that which the head is capable of delivering to the pipe wall so as to prevent flooding the chamber 219. The spray head 130 is rotated by the motor 194 at generally a fixed speed, and the acceleration given to the coating material may be changed by varying the spacer size. The larger the width (W) of the annular slot or orifice or the lesser the length (R) of the disc 216, the lesser the acceleration transferred to the coating material. Adjustment for the various viscosities of coating material or changes in operating conditions may also be made by disassembling the discs 210, 216 and 218 and substituting thicker or thinner spacers 224, as needed, the thinner spacers being used for the lower viscosity materials.

Operation of coating apparatus of the present invention, and particularly that of embodiment 20, will now be described, it being understood that operation of the apparatus 120 is similar. Referring to FIG. 1, first the tractor 22 is positioned so its direction of movement is parallel to the open ends of a plurality of stacked pipes 240. The adjustment means 26 is used to bring the traveling boom 24 and spray means 30 into rough alignment with the longitudinal axis of the pipe to be coated, such as the pipe 241, this being primarily accomplished by adjusting the cylinders 38 and 44. The traveling boom 24 is then brought into more precise alignment by adjustment of the leveling cylinders 58 and 60. The adjustment of the boom 124 is aided by a mirror 242 mounted on the frame member 48 which lets the operator check the alignment of the traveling boom 24 in the pipe 241 without leaving the cab 35. The air motor, similar to air motor 194, for the spray means 30 is started rotating in one direction, say clockwise; the coating material is allowed to flow to spraying means 30, such as by opening a valve. Shortly thereafter, the air motor 112 for the boom 24 is rotated to drive the boom and spraying means 30 into the pipe 241. The coating material 243 is driven out centrifically and strikes and adheres to the inner surcace 245 of the pipe. After passing completely through the pipe 241, the flow of coating material may be momentarily stopped; the air for the motors 112 and 194 is stopped; then the motors are reversed in direction of rotation for the return trip through the pipe; and the flow of coating material is again initiated. The flow of coating material and air to the motors is shut off after completing the return trip. After spraying of the pipe 241 is completed, the tractor 22 is advanced to the next pipe, and the above described operations may be again carried out until all the pipes in the stack have been coated.

The coating material is applied to the pipe with a radial, tangential and an axial component in one direction on the forward travel through the pipe, and has a similar radial component but opposite direction tangential and axial components during the return travel. The change in direction of the tangential component and to a lesser degree that of the axial component helps to provide equal and uniform paint or coating distribution on irregularities or structural members in the pipe, such as ridges or grooves, so as to minimize "ghosting" or "shading."

Figure 7:
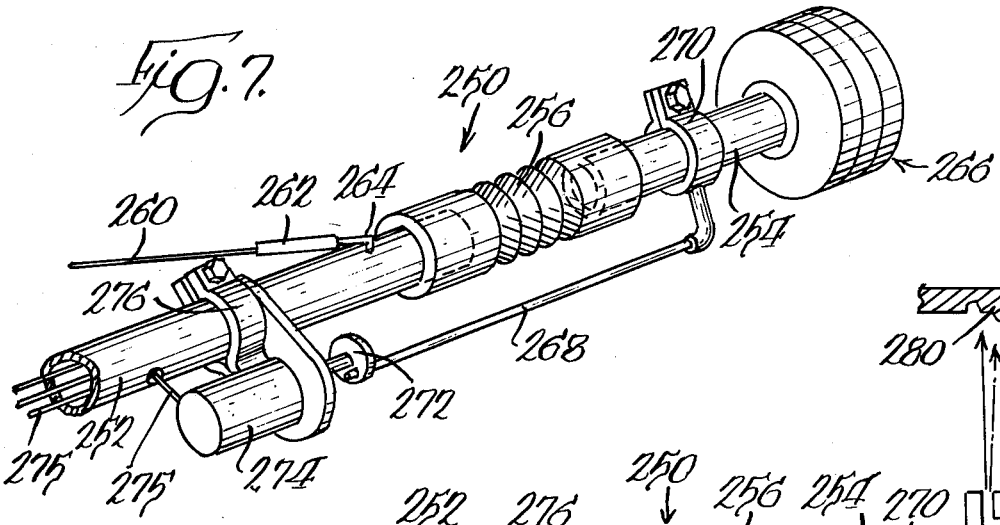
FIG. 7 is a perspective view of an alternative embodiment of spraying means.
Figure 8:
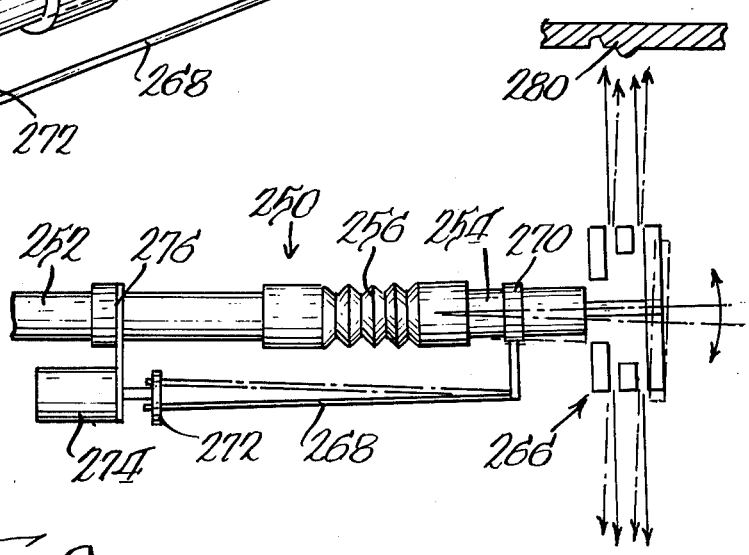
FIG. 8 is a schematic diagram illustrating the operation of the spraying means of FIG. 7.

Referring to FIG. 7, an alternative embodiment of spray means 250 also is useful in minimizing "ghosting" or "shading." In this embodiment, the traveling boom has been modified slightly so that it has a main portion 252 and a stub portion 254 joined by a flexible means such as a rubber coated wire reinforced coupling 256. The support cable 260 with its turnbuckle 262 and hook end 264 is received in an opening in the portion 252 just before the portion 254. The flexible coupling 256 may be secured to the portions 252 and 254 by various means, such as hose clamps. The portion 254 carries the air motor, similar to the air motor 194, and a spray disc assembly 266, similar to the spray disc assembly 130 previously described. In addition, an eccentric or oscillating drive is provided so that the spray disc assembly 266 will "wiggle" or oscillate, thus, facilitating coating of irregularities. The eccentric drive of the portion 254 is provided by means of a rod 268 which is secured by a clamp 270 at one end to the portion 254 and slidably engages in an eccentric opening provided in a rotatable disc 272 driven by another air motor 274. The air motor 274 is secured to the portion 252 by a clamp 276 and is supplied by an air line 275. The size of the air motor 274 and clamp 276 are such as not to extend beyond the radius of the spray disc assembly 266 so as not to reduce the ability of the apparatus 250 to coat narrow pipes. As shown in FIG. 8 in solid and dotted lines, as the air motor 274 rotates the disc 272, the rod 268 "wiggles" back and forth and causes the spray means 250 also to "wiggle" in a manner to assist spraying coating material uniformly across an irregularity, such as that depicted at reference numeral 280, because of the changes in direction with which the coating material strikes the irregularity.

Figure 9:
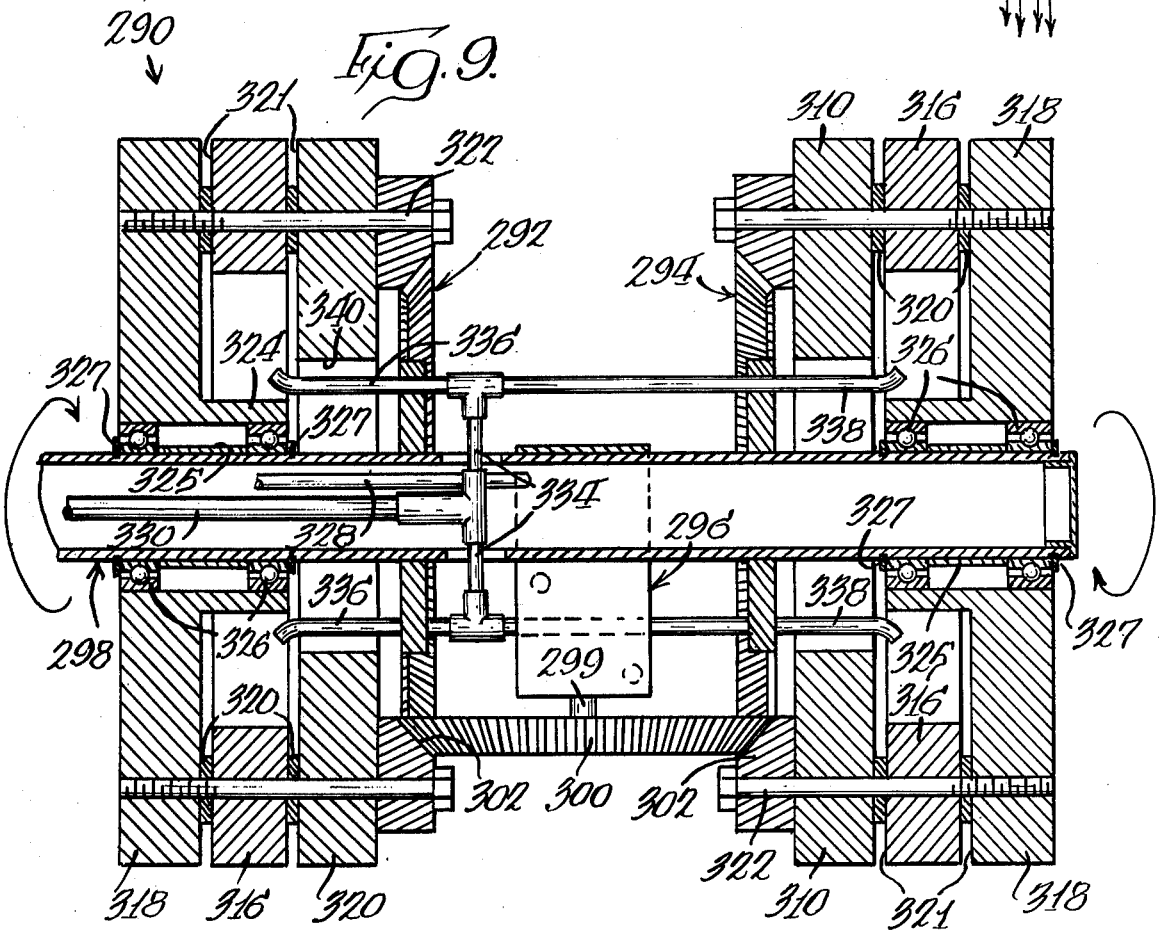
FIG. 9 is a cross-sectional view of a second alternative embodiment of spraying means.

Referring to FIG. 9, another alternative spray means 290 comprises counter-rotating spray disc assemblies 292 and 294 driven by a single air motor 296. The air motor 296 is transversely mounted in openings provided in the wall of the traveling boom 298. On one end the air motor 296 has a shaft 299 carrying a pinion gear 300 which in turn drives a pair of ring gears 302 in opposite directions, one mounted on each of the spray heads 292 and 294. Each head 292 and 294 comprises one of the ring gears 302, a first disc 310, a second annular disc 316 and a third disc 318, the discs being separated by spacers or washers 320 to form peripheral orifices 321 and secured together by bolts 322. The third disc 318 has an inner annular extending portion 324 which receives a pair of ball bearings 326 to rotatably mount the disc 318 on the traveling boom 298, the bearings 326 being secured as by press fit into the annular portions 324 and secured onto the traveling boom by an intermediate sleeve 325 and two snap rings 327. Air is supplied to the air motor 296 by a line 328, and paint or coating material is supplied to the spray heads 292 and 294 by a line 330 which divides into two branch lines 334, each of which in turn divides into two lines 336 and 338 extending through openings 340 in the first discs 310 to feed coating material to the spray heads 292 and 294. Just as in the previously described spray means 30 and 130, the provision of dual or more input lines into the inner material chamber of the spray means helps distribute the coating material, and eliminates the need for mechanical distributors heretofore sometimes used in the prior art.

Operation of the spray means 290 is similar to that of spraying means 30, except that on both the forward and return travel of the traveling boom 298, the pipe surface is coated twice, once by material from the peripheral orifices 321 of the spray head 292 which has a tangential component in one direction and again by the material from the peripheral orifices 321 of the spray head 294 which has a tangential component in the opposite direction. The spraying of the pipe surface with two sprays having tangential components in opposite directions minimizes "ghosting" or "shading."

Should the length of the pipe being coated be long, say over 30 feet, it is still possible to coat such pipe by entering and coating the pipe from both of its ends. However, if the pipe should be longer or it is necessary to coat the pipe all from one end it becomes difficult, even with the cable support of the apparatus of the present invention, to hold the spraying means at or near the center of the pipe. If the spraying means is not held near the center of the pipe, "ghosting" can become particularly severe. Even worse yet, on such long reaches into the pipe, the inner pipe surface may be scraped or touched by the spinning spraying means, resulting in damage to either or both.

Figure 10:
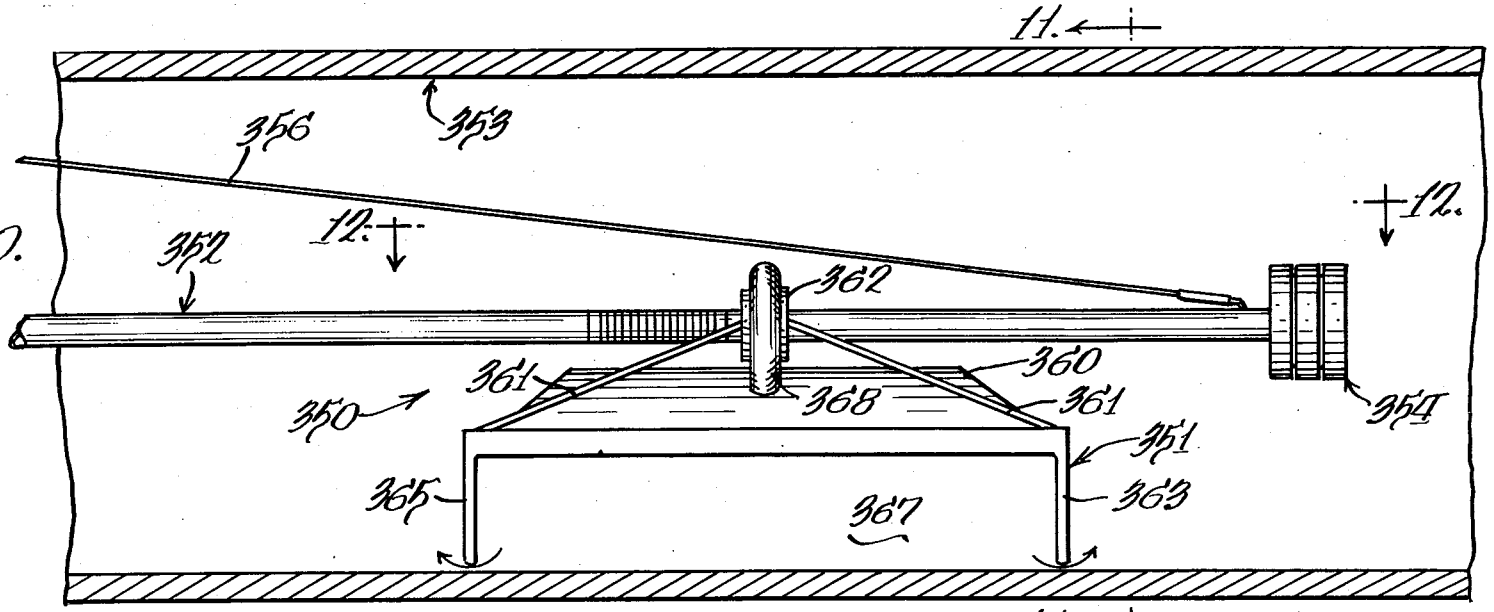
FIG. 10 is a cross-sectional view of an auxiliary air support for use with the apparatus of FIG. 1.
Figure 12:
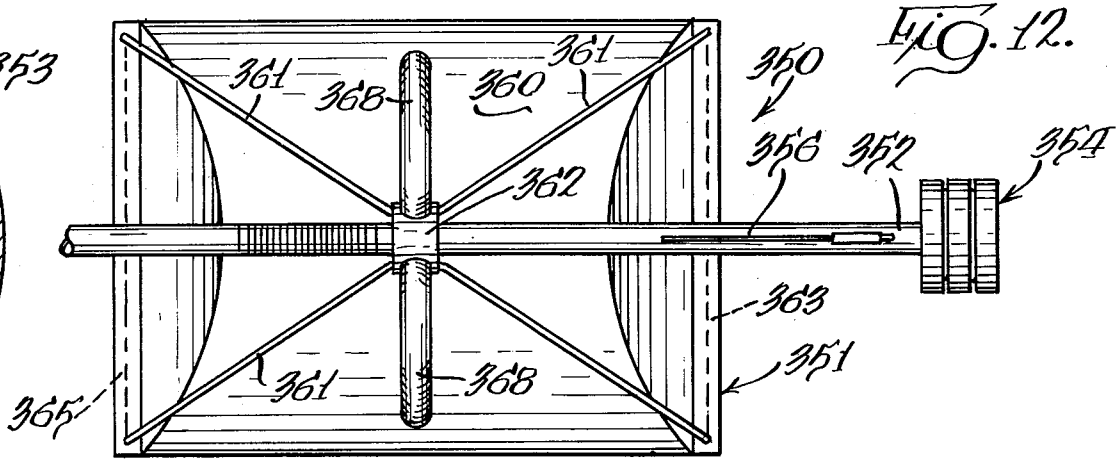
FIG. 12 is a fragementary plane view taken substantially in the direction of the arrows 12—12 of FIG. 10.
Figure 11:
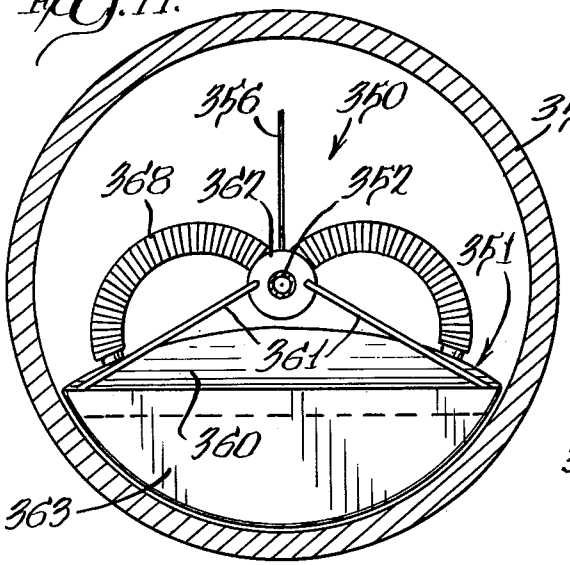
FIG. 11 is a cross-sectional view taken substantially along the line 11—11 of FIG. 10.

Referring to FIG. 10, the above disadvantages are overcome by another alternative embodiment of spray means 350 comprising an air support 351 for carrying the end of a traveling boom 352 through a pipe 353 and a spray head or disc assembly 354, similar to the spraying means 130, previously described. The boom 352 has a cable 356 secured thereto and may be reciprocated by a cable drive (not shown), similar to that for the apparatus 20 previously described. The air support 351 is located adjacent and secured to the end of the traveling boom 352 and includes an upper inverted trough shaped member 360 having forward and rearward ends 363 and 365 with lower portions thereof following the inner periphery or circumference of the pipe. Four reinforcement rods 361 extend from the trough member 360 to the traveling boom 352 for additional strength and support. The upper member 360 and forward and rearward ends 363 and 365 cooperate with the inner wall of the pipe 353 to define a chamber 367 to which air pressure may be supplied to float the support 351 in the pipe so that the support does not touch the pipe. The air pressure may be supplied from the air line used to drive the spraying means 354 by providing an appropriate opening in the line. Air from that line may be fed into a manifold 362 encircling the boom 352 and from there by flexible hoses 368 to openings provided in the trough member 360 to the chamber 367. Since the area beneath the support 351 is relatively large and the weight to be supported relatively light only a moderate quantity of pressurized air is needed, but if part or all of the spray equipment, such as compressors and containers were also mounted on the support 351, a higher quantity of air pressure would be needed and could be supplied by a separate line. As is believed apparent, the air pressure is discharged from the chamber 367 along the perimeter of the air support 351 and the pipe 353, the support 351 never touching the pipe. Of course the trough member 360 and lower end members 363 and 365 may be changed or altered so that the support 351 may be used in larger or smaller pipes.

While the spraying means has been described with reference to a device for spraying epoxy or paint, it also may include a spraying device for spraying sand for sandblasting the interior of the pipe preparatory to applying the paint. Such sand spray device could be a multi-nozzle device carried by apparatus 20 or 120 through a pipe.

While only several embodiments of the apparatus of the present invention have been illustrated and described, it is to be understood that modifications, variations and equivalent structure fall within the scope of the appended claims.

What is claimed is:

1. In apparatus for coating the interior surface of a pipe or the like, in combination, a mobile vehicle, a traveling boom reciprocally movable on said vehicle and adapted to be moved into and out of the pipe, adjustment means on said vehicle for varying the relative position of said traveling boom and bringing it into alignment with the longitudinal axis of the pipe, means on said vehicle for reciprocating and supporting said traveling boom for movement into and out of the pipe, said means for supporting said traveling boom being adapted to be always spaced from the interior surface of the pipe, and spraying means secured adjacent an end of said traveling boom, said reciprocating and supporting means comprising flexible means secured to opposite ends of said traveling boom, and a driven pulley rotatably supported on said vehicle, said flexible means having a mediate portion wrapping around said pulley, whereby rotation of said pulley drives said flexible means and said traveling boom, and the interior surface of the pipe may be coated without any portion of said apparatus touching the inner surface of the pipe.

2. Apparatus as in claim 1, wherein said pulley is located on said vehicle to provide an included angle between said flexible means and said traveling boom varying as said boom reciprocates, said included angle varying between about 20° at one end of travel and about 4° at the other end of travel.

3. Apparatus as in claim 2, wherein said flexible means is a cable.

4. In apparatus for coating the interior surface of a pipe or the like, in combination, a mobile vehicle adapted to travel directly across and on the ground, a traveling boom reciprocally movable on and relative to said vehicle and adapted to be moved into and out of the pipe, adjustment means on said vehicle for varying the relative position of said traveling boom and bringing it into alignment with the longitudinal axis of the pipe, means on said vehicle for reciprocating, supporting and guiding said traveling boom for movement into and out of the pipe, said means for reciprocating, supporting and guiding said traveling boom being spaced from and out-of-contact with the interior surface of the pipe, and spraying means secured adjacent an end of said traveling boom for applying a coating to the interior of the pipe, said spraying means being spaced from and out-of-contact with the interior surface of the pipe, said reciprocating, supporting and guiding means includes a flexible cable having one portion attached to said traveling boom and another portion attached to said vehicle, the attachment of at least one or the other portions permitting reciprocation of said traveling boom, whereby the interior surface of the pipe may be coated without any portion of said apparatus touching or contacting the inner surface of the pipe.

5. In apparatus for coating the interior surface of a generally vertical pipe or the like, in combination, a mobile vehicle adapted to travel directly across and on the ground, a traveling boom reciprocally movable on and relative to said vehicle and adapted to be moved into and out of the pipe, adjustment means on said vehicle for varying the relative position of said traveling boom and bringing it into alignment with the longitudinal axis of the pipe, means on said vehicle for reciprocating, supporting and guiding said traveling boom for movement into and out of the pipe, said means for reciprocating, supporting and guiding said traveling boom being spaced from and out-of-contact with the interior surface of the pipe, and spraying means secured adjacent an end of said traveling boom for applying a coating to the interior of the pipe, said spraying means being spaced from and out-of-contact with the interior surface of the pipe, said traveling boom extending vertically from said vehicle and being adapted to be extended downwardly into the generally vertical pipe, said apparatus further comprising a cradle guiding said traveling boom and extending generally vertically from said vehicle, said adjustment means comprising pivoting means on one end of said cradle and movement means at the opposite end of said cradle for varying the relative position of said cradle to the vertical pipe, said reciprocating, supporting and guiding means comprising a pair of flexible cables on opposite sides of said traveling boom, each of said cables having one portion secured to said traveling boom and another portion adjustably attached to said vehicle to accommodate movement of said traveling boom, whereby the interior surface of the pipe may be coated without any portion of said apparatus touching or contacting the inner surface of the pipe.

6. In apparatus for coating the interior surface of a pipe or the like, in combination, a mobile vehicle, a traveling boom reciprocally movable on said vehicle and adapted to be moved into and out of the pipe, adjustment means on said vehicle for varying the relative position of said traveling boom and bringing it into alignment with the longitudinal axis of the pipe, means on said vehicle for reciprocating and supporting said traveling boom for movement into and out of the pipe, said means for supporting said traveling boom being adapted to be always spaced from the interior surface of the pipe, and spraying means secured adjacent an end of said traveling boom, said spraying means comprising a plurality of discs rotatably mounted on said traveling boom, at least one of said discs forming a material receiving chamber, a plurality of spacers between said discs, said discs being held apart by said spacers to form at least one generally peripheral orifice communicating with said material receiving chamber, means for securing said spacers and discs together, means for rotating said discs, said means for rotating said discs being rotatable in opposite directions, and means for supplying coating material to said material receiving chamber, whereby upon rotation of said discs and supplying coating materials to said material receiving chamber the coating material is expelled through said peripheral orifice to coat the interior of the pipe and the interior surface of the pipe may be coated without any portion of said apparatus touching the inner surface of the pipe.

7. Apparatus as in claim 6, wherein said spraying means further includes flexible connecting means for securing said spraying means to said traveling boom and means for oscillating said spraying means out of a plane perpendicular to the longitudinal axis of said traveling boom.

8. In apparatus for coating the interior surface of a vertical pipe or the like located in the ground, in combination, a mobile vehicle adapted to be located over the pipe, a traveling boom reciprocally movable on said vehicle, extending vertically from said vehicle, being adapted to be extended downwardly into the vertical opening of the pipe or the like and adapted to be moved into and out of the pipe, adjustment means on said vehicle for varying the relative position of said traveling boom and bringing it into alignment with the longitudinal axis of the pipe, means on said vehicle for reciprocating and supporting said traveling boom for movement into and out of the pipe, said means for supporting said traveling boom being adapted to be always spaced from the interior surface of the pipe, and spraying means secured adjacent an end of said traveling boom, said spraying means further including flexible means for securing said spraying means to said traveling boom and means for oscillating said spraying means out of a plane perpendicular to the longitudinal axis of said traveling boom, whereby the interior surface of the pipe may be coated without any portion of said apparatus touching the inner surface of the pipe.

9. In apparatus for coating the interior surface of a pipe or the like, in combination, a support frame adapted to be carried by a mobile vehicle, a cradle pivotally mounted on two axes on said support frame, a traveling boom movable relative to said cradle and adapted to be moved into and out of the pipe, bearing means on said cradle for said traveling boom, movement means on said support frame for varying the relative position of said cradle and to bring said traveling boom into alignment with the longitudinal axis of the pipe, means on said support frame for driving and supporting said traveling boom for movement into and out of the pipe, the last mentioned means at all times being spaced from the interior surface of the pipe, said driving and supporting means comprising a flexible cable secured to opposite ends of said traveling boom, and a driven pulley mounted on said cradle, a mediate portion of said flexible cable being wrapped around said pulley for driving and supporting said traveling boom and spraying means secured adjacent an end of said traveling boom, whereby the interior surface of the pipe may be coated without any portion of said apparatus touching the interior surface of the pipe.

* * * * *